United States Patent [19]

Self

[11] Patent Number: 4,687,032

[45] Date of Patent: Aug. 18, 1987

[54] FIRE EXTINGUISHER EXTRACTOR APPARATUS

[76] Inventor: Freddy Self, 933 Parkside Dr., Richmond, Calif. 94803

[21] Appl. No.: 766,516

[22] Filed: Aug. 19, 1985

[51] Int. Cl.[4] ..... B65B 1/04

[52] U.S. Cl. ..... 141/18; 141/98; 141/286

[58] Field of Search ..... 141/285–310, 141/2, 18–29, 98

[56] References Cited

U.S. PATENT DOCUMENTS 135,074 1/1873 Brown ..... 141/290

996,972 7/1911 Caris et al. ..... 141/290

*Primary Examiner*—Houston S. Bell, Jr.

*Attorney, Agent, or Firm*—Bielen and Peterson

[57] ABSTRACT

An apparatus for extracting fire extinguisher powder from a fire extinguisher utilizing a container for the powder and first and second funnels. First funnel communicates with the container and directs powder into the second funnel. A connector between the first and second funnels forms a funnel unit such that the second funnel communicates with the fire extinguisher being filled from the container.

6 Claims, 3 Drawing Figures

FIRE EXTINGUISHER EXTRACTOR APPARATUS

BACKGROUND OF THE INVENTION

The present invention relates to a device for recycling powder from fire extinguishers.

Dry chemicals used in fire extinguisher are recoverable when the fire extinguishers are being recharged. Often this requires removing the dry fire extinguisher chemical from the fire extinguisher and refilling the same into the fire extinguisher followed by the normal pressurization by inert gases such as air and nitrogen.

U.S. Pat. No. 4,245,679 describes a device which successfully use a gravity feed to transfer dry chemical from a container to a fire extinguisher. However, the dry chemical extractor shown in U.S. Pat. No. 2,245,679 did not permit flow in the opposite direction to allow unused dry chemical within the extractor to flow back to the container or pail.

A dry chemical extractor for fire extinguisher which is completely reversible would be an advance in the fire combatting field.

SUMMARY OF THE INVENTION

In accordance with the present invention a novel and useful fire extinguisher powder extraction device is provided which solves certain problems in the prior art.

The apparatus or device of the present invention utilizes a container for the fire extinguisher powder. The container includes a mouth which communicates with a wide opening of a first funnel. A second funnel is also included in the apparatus of the present invention such that the wide opening the second funnel lies adjacent and apart from the narrow opening of the first funnel.

Means is also employed in the apparatus of the present invention for connecting the narrow opening of the first funnel to the wide opening of the second funnel to form a funnel unit. Such connecting means may take a form of a third funnel having a wide opening matching the wide opening of the second funnel and a narrow matching the narrow opening of first funnel. Thus, the funnel in unit does not include any dead spaces to inhibit the flow of fire extinguisher chemical back and forth through the funnel unit.

Means for communicating the narrow opening of the second funnel with the fire extinguisher is also included in the apparatus. Such an element permits fire extinguisher powder to gravity flow from the container to the fire extinguisher when the container is above the fire extinguisher. Valve means may be interposed the narrow opening of the second funnel and the fire extinguisher to control the rate or to stop the flowing of the same.

Means for attenuating the lumping of the fire extinguisher powder may also be incorporated into the apparatus and include a series of screens being fixed within the funneling unit. The container may be detachably connected to the first funnel to allow easy access to the container.

It may be apparent that a novel and useful fire extinguisher powder extractor has been described.

It is therefore an object of the present invention to provide a fire extinguisher powder extractor which is fully capable of recycling fire extinguisher powder from fire extnguishers or filling fire extinguisher with fresh powder with a minimum loss of powder in the operation.

It is another object of the present invention to provide a fire extinguisher powder extractor which essentially eliminates contact of the user's skin with the fire extinguisher powder during the process of recycling of the same.

Another object of the present invention is to provide a fire extinguisher powder extractor which permits the powder to flow under the force of gracity in either direction through a funnel unit placed between a container for the powder and the fire extinguisher itself.

Another object of the present invention is to provide a fire extinguisher which operates as a closed system protecting the fire extinguisher powder from moisture contamination.

The invention possesses other objects and advantages especially as concerns particular characteristics and features thereof which will become apparent as the specification continues.

Figure 1:
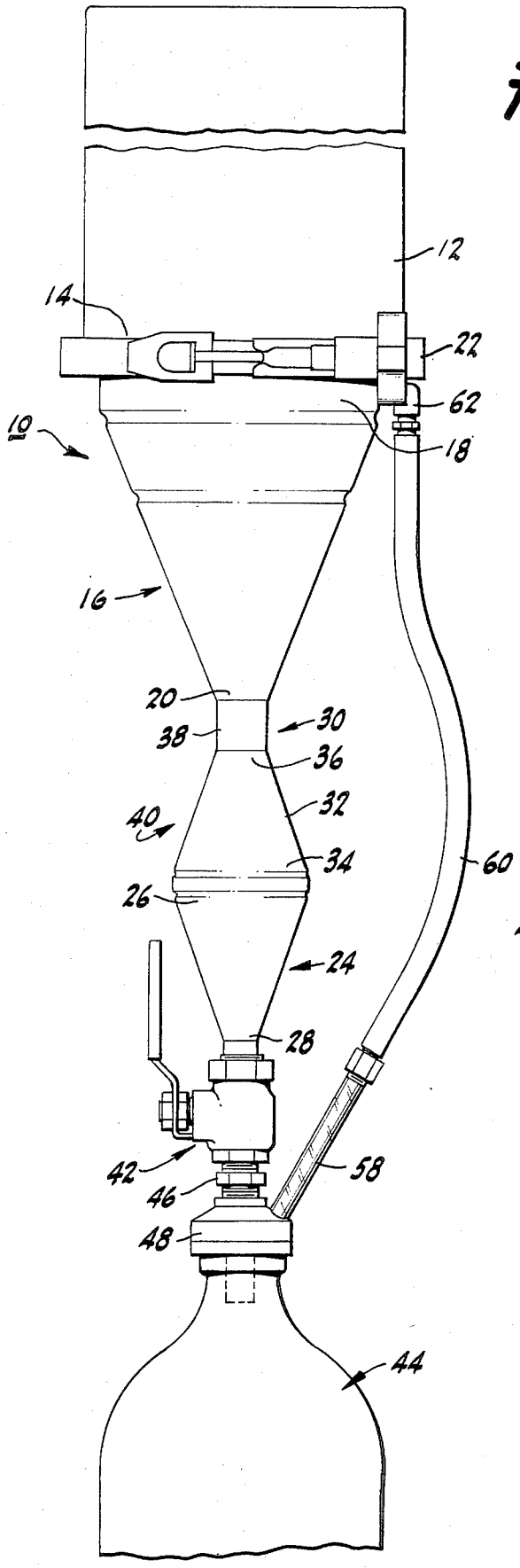
FIG. 1 is a broken side elevational view of the apparatus of the present invention.

For a better understanding of the invention reference is made to the hereinafter description of the preferred embodiments of the invention which should be referenced to the hereinabove drawings.

DESCRIPTION OF THE PREFERRED EMBODIMENTS

Various aspects of the present invention will evolve from following detailed description of the preferred embodiments thereof which should be referenced to the hereinabove described drawings.

The apparatus as a whole is identified in the drawings by reference character 10. The dry chemical fire extinguisher extraction apparatus 10 includes as one of its elements a container 12 which is capable of holding fire extinguisher powder, FIG. 1. Container 12 includes a mouth 14. A first funnel 16 having a wide opening 18 and a narrow opening 20 lies immediately adjacent container 12 and is detachable linked thereto by Vee clamp 22 such as clamp part #051239 manufactured by the R. G. Ray Corporation of 1425 Dayne Road, Schaumberg, Ill.

Second funnel 24 may also be found in apparatus 10 and includes a wide opening 26 and a narrow opening 28. Wide opening 26 of funnel 24 wide adjacent and below narrow opening 20 of first funnel 16 as shown in FIG. 1. Means 30 is included in apparatus 10 for connecting wide opening 26 of second funnel 24 to the narrow opening 20 of first funnel 16. Means 30 may include a third funnel 32 having a wide opening 34 and a narrow opening 36. A cylindrical member 38 completes the connection such that first funnel 16, second funnel 24, third funnel 32 and cylindrical member 38 form a funnel unit 40.

The narrow opening of second funnel 24 feeds through valve 42 and into fire extinguisher 44. Valve 42 includes a threaded nipple 46 which threadingly engages the female threaded member 48. Valve 42 may be a ball valve, Model SS316, manufactured by Watts Valve and Regulator Co., Lawrence, MA.

Figure 2:
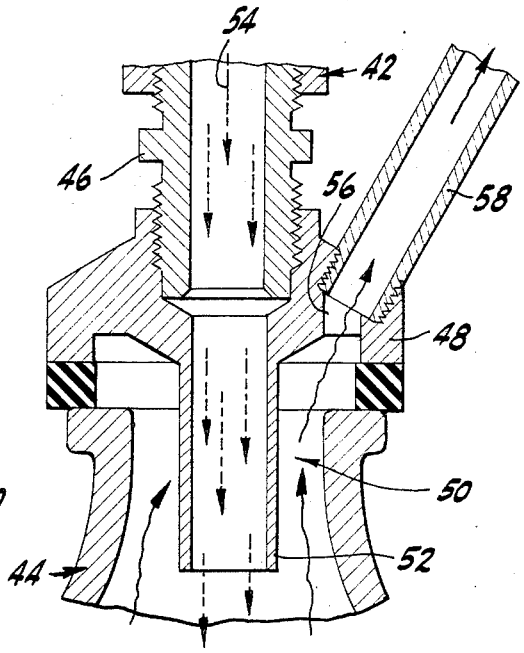
FIG. 2 is a broken sectional view the interconnection between the funnel unit of the present invention of the fire extinguisher.

Tuning to FIG. 2 it may be seen that means 50 for conducting air from fire extinguisher 44 to container 12 is illustrated. conduit 52 extends within the upper portion of fire extinguisher 44 and carries fire extinguisher material from funnel unit 40, shown by plurality of broken arrows 54. Air within fire extinguisher 44 travels upwardly to opening 56 of member 48 and conduit 58. Conduit 58 holds 60 and elbow 62 carry air back to the mouth of the first funnel 16. At this point elbow 64 and check valve 66 send air down through first funnel 16 to aid in the movement of fire extinguisher material therethrough, best shown in FIGS. 1 and 3. Valve 66 may be constricted of rubber or other elastomeric material such that air may pass into funnel unit 40 (FIG. 1 position of apparatus 10). However, valve 66 bends or collapses to prevent powder from passing into conduit 60 (FIG. 3 position of apparatus 10).

Figure 3:
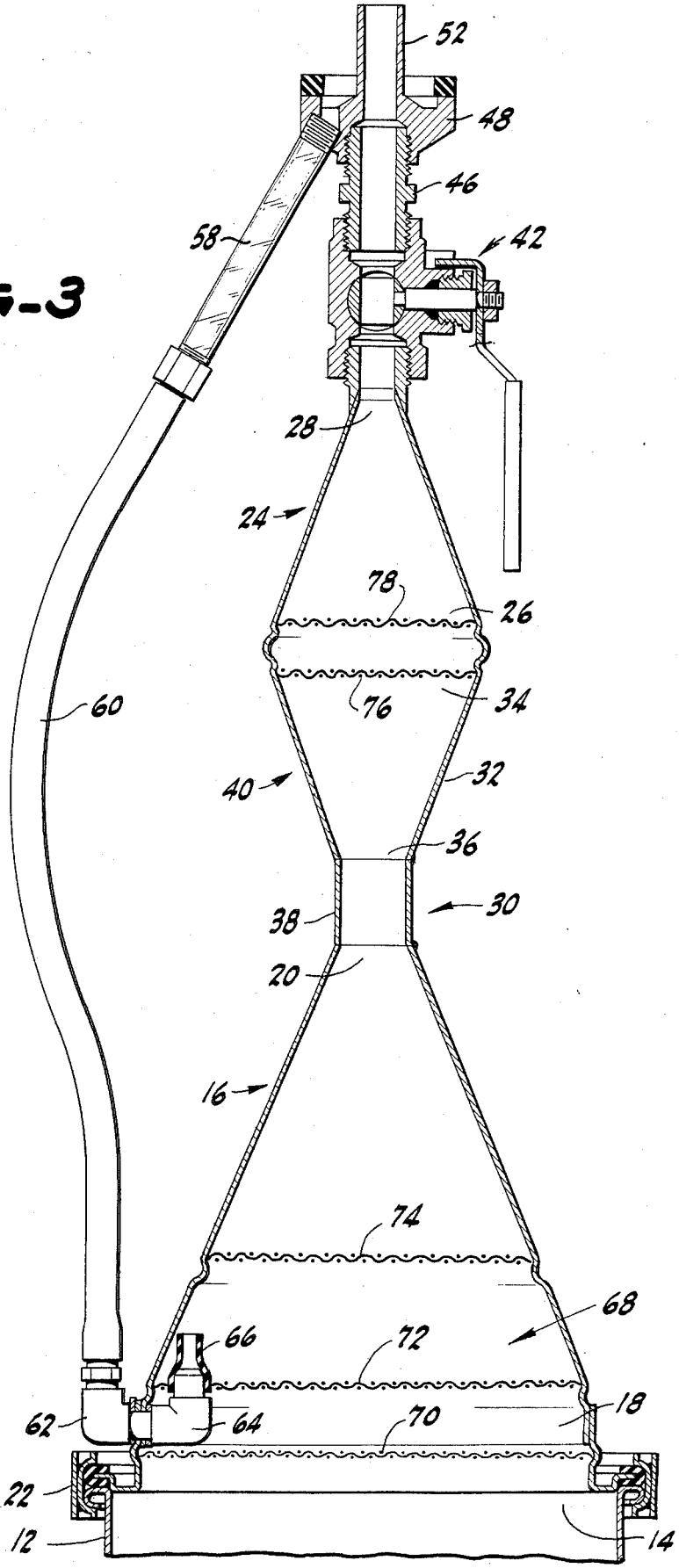
FIG. 3 is a sectional view of the funnel unit and a portion of the containter of the present invention is an upside down position.

Turning to FIG. 3 it may be seen that means 68 attenuates the lumping of the fire extinguisher powder and may take the form of a series of screens 70, 72, and 74, in first funnel 16 and 76 and 78 in second funnel 24. As the fire extinguisher material can lump at any time, means 68 attenuating the lumping of fire extinguisher powder will act when the material flows either direction through funnel unit 40. For example screens 70, 72, 76 and 78 and ½" size. Screen 74 is ¼" size. It has been found that the larger screen sizes of screens 70, 72, 76 and 78 aid in the initiation of flow of the powder when the apparatus 10 is in either position (FIGS. 1 and 3).

In operation, the user discharges the fire extinguisher powder from fire extinguisher 44 into container 12 or provides fire extinguisher 44 into container 12 or provides fire extinguisher material in container 12 from any other source. Turning to FIG. 1, it may be seen that the material gravity flows from funnel unit 40 and into fire extinguisher 44. Means 68 prevents the clogging of apparatus 10 by the lumping of the material. Air is recycled from fire extinguisher 44 through hose 60 and into first funnel 16 to aid in this endeavor. When fire extinguisher 44 has be filled valve 42 is closed. Any powder in tube 60 and in the components below valve 42 will settle back into fire extinguisher 44. Funnel unit 40 and container 12 attached thereto are removed from fire extinguisher 44 and turned upside-down as shown in FIG. 3. Any residual fire extinguisher powder found within the funnel unit 40, and on the funnel unit side of valve 42, will travel downwardly by gravity into container 12. Means 68 would again insure the free flow of material. Valve 66 located within first funnel 16 stops the powder flow back through hose 60 and out through conduit 58. Thus, apparatus 10 very efficiently conserves fire extinguisher material during the recharging of fire extinguishers, and prevents moisture contamination of the powder; a potentially corrosive environment.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An apparatus for extracting fire extinguisher powder from a fire extinguisher comprising:

a. a container for the powder, said container having a mouth;

b. a first funnel having a wide opening at a first end and a relatively narrow opening at a second end said first funnel being connectable to said container with said wide opening of said first funnel communicating with said mouth of said container;

c. a second funnel having a wide opening at a first end and a relatively narrow opening, at a second end said wide opening of said second funnel lying adjacent and apart from said narrow opening of said first funnel;

d. means for connecting said narrow opening of said first funnel to said wide opening of said second funnel to form a funnel unit, said connecting means extending from said second end of said first funnel to said first end of said second funnel, said funnel unit permitting flow of fire extinguisher powder through said first and second funnels;

e. means for attenuating the lumping of the fire extinguisher powder traveling from said container through said funnel unit and from said narrow opening of said second funnel; and f. means for communicating said narrow opening of said second funnel with said fire extinguisher, such that fire extinguisher powder is able to gravity flow from said container to said fire extinguisher when said container is above the fire extinguisher and is able to gravity flow in the opposite direction when the fire extinguisher is above the container.

2. The apparatus of claim 1 which additionally comprises valve means interposed said narrow opening of said second funnel and the fire extinguisher.

3. The apparatus of claim 2 which additionally comprises means for conducting air from said fire extinguisher to said container.

4. The apparatus fo claim 3 in which said means for connecting said narrow opening of said first funnel to said wide opening of said second funnel comprises a third funnel having a narrow opening at a first end and a wide opening at a second end, said first end of said third funnel connecting to said second end of said first funnel, and said second end of said third funnel connecting to said first end of said second funnel.

5. The apparatus of claim 4 in which said means for attenuating the lumping of the fire extinguisher powder comprises screen means for dividing said powder, said screen means being fixed within said funnel unit.

6. The apparatus of claim 5 which additionally comprises means for detachably connecting said container to said first funnel.

* * * * *